US008216010B2

(12) United States Patent
Ochiai

(10) Patent No.: US 8,216,010 B2
(45) Date of Patent: Jul. 10, 2012

(54) OUTBOARD MOTOR

(75) Inventor: Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 218 days.

(21) Appl. No.: 12/723,791

(22) Filed: Mar. 15, 2010

(65) Prior Publication Data

US 2010/0240270 A1 Sep. 23, 2010

(30) Foreign Application Priority Data

Mar. 19, 2009 (JP) ..... 2009-067651

(51) Int. Cl.
*F01N 3/04* (2006.01)
*F01N 3/28* (2006.01)
*F01N 13/00* (2010.01)

(52) U.S. Cl. ..... 440/89 H

(58) Field of Classification Search ..... 440/88 R, 440/88 C, 88 HE, 89 B, 89 R, 89 G, 89 H; 60/313

See application file for complete search history.

(56) References Cited

U.S. PATENT DOCUMENTS

| | | | | |
|---|---|---|---|---|
| 6,884,133 | B2 * | 4/2005 | Ishii | 440/89 H |
| 7,704,111 | B2 * | 4/2010 | Ito et al. | 440/89 R |
| 7,954,314 | B1 * | 6/2011 | Bruestle et al. | 60/313 |
| 2008/0166935 | A1 | 7/2008 | Ito et al. | |

* cited by examiner

*Primary Examiner* — Daniel Venne
(74) *Attorney, Agent, or Firm* — Keating & Bennett, LLP

(57) ABSTRACT

An outboard motor includes an engine and a catalyst. The engine includes a cylinder and a cylinder head. The engine includes an exhaust port, a catalyst housing portion, a first exhaust passage, and a passage defining member. The exhaust port is provided in the cylinder head. The catalyst housing portion is provided at a side portion of the cylinder head. The first exhaust passage is arranged to guide exhaust discharged from the exhaust port into an interior of the catalyst housing portion. The passage defining member defines a second exhaust passage. The second exhaust passage is arranged such that exhaust that has passed through the interior of the catalyst housing portion flows into the second exhaust passage. The catalyst is held by the engine in a state in which at least a portion of the catalyst is housed in the interior of the catalyst housing portion.

8 Claims, 17 Drawing Sheets

OUTBOARD MOTOR

BACKGROUND OF THE INVENTION

1. Field of the Invention

The present invention relates to an outboard motor.

2. Description of the Related Art

An outboard motor according to a prior art is described in US 2008/0166935 A1. The outboard motor includes an engine, an engine holder, an exhaust manifold, and a catalyst. The engine is supported from below by the engine holder. The engine includes a cylinder head. The exhaust manifold is disposed at a side of the cylinder head. The exhaust manifold extends vertically at the side of the cylinder head. An upper end portion of the exhaust manifold is coupled to the cylinder head by bolts. Also, a lower end portion of the exhaust manifold is coupled to the engine holder by bolts. The exhaust manifold includes a cooling water passage. The exhaust manifold is cooled by cooling water. The catalyst is disposed inside the manifold.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

That is, in a state in which the engine is rotating at low speed and an output of the engine is low, a temperature of the engine is lower and a flow rate of exhaust is lower than in a state in which the engine is rotating at high speed or a state in which the output of the engine is high. Also, with the outboard motor according to the prior art described above, the exhaust is cooled by the engine and the exhaust manifold before reaching the catalyst. Thus, in the state in which the engine is rotating at low speed and the output of the engine is low, a heat amount applied to the catalyst from the exhaust is small. The catalyst may thus not be warmed adequately by the exhaust. Thus, in a case where the catalyst is a catalyst that exhibits an adequate cleaning ability at high temperature (for example, a three-way catalyst), the cleaning ability of the catalyst is not performed adequately. Also, during starting of the engine, the temperature of the catalyst is low. Thus, in the case where the catalyst is a catalyst that performs an adequate cleaning ability at high temperature, the temperature of the catalyst is preferably raised to a high temperature quickly after the engine is started.

In order to overcome the previously unrecognized and unsolved challenges described above, a preferred embodiment of the present invention provides an outboard motor including an engine and a catalyst. The engine includes a cylinder body and a cylinder head that are aligned in a front/rear direction. The catalyst is held by the engine. The engine includes an exhaust port, a catalyst housing portion, a first exhaust passage, and a passage defining member. The exhaust port is provided in the cylinder head. The catalyst housing portion is provided at a side portion of the cylinder head. The first exhaust passage is arranged to guide exhaust discharged from the exhaust port into an interior of the catalyst housing portion. The passage defining member defines a second exhaust passage. The second exhaust passage is arranged such that exhaust that has passed through the interior of the catalyst housing portion flows into the second exhaust passage. The catalyst is held by the engine in a state in which at least a portion of the catalyst is housed in the interior of the catalyst housing portion.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

An outboard motor according to a first preferred embodiment of the present invention shall now be explained in detail with reference to FIG. 1A to FIG. 12. In the figures, an arrow F indicates a front side of the outboard motor. In the description that follows, "front side," "rear side," "right side," and "left side" refer to the front side, rear side, right side, and left side, respectively, of the outboard motor.

Figure 1A:
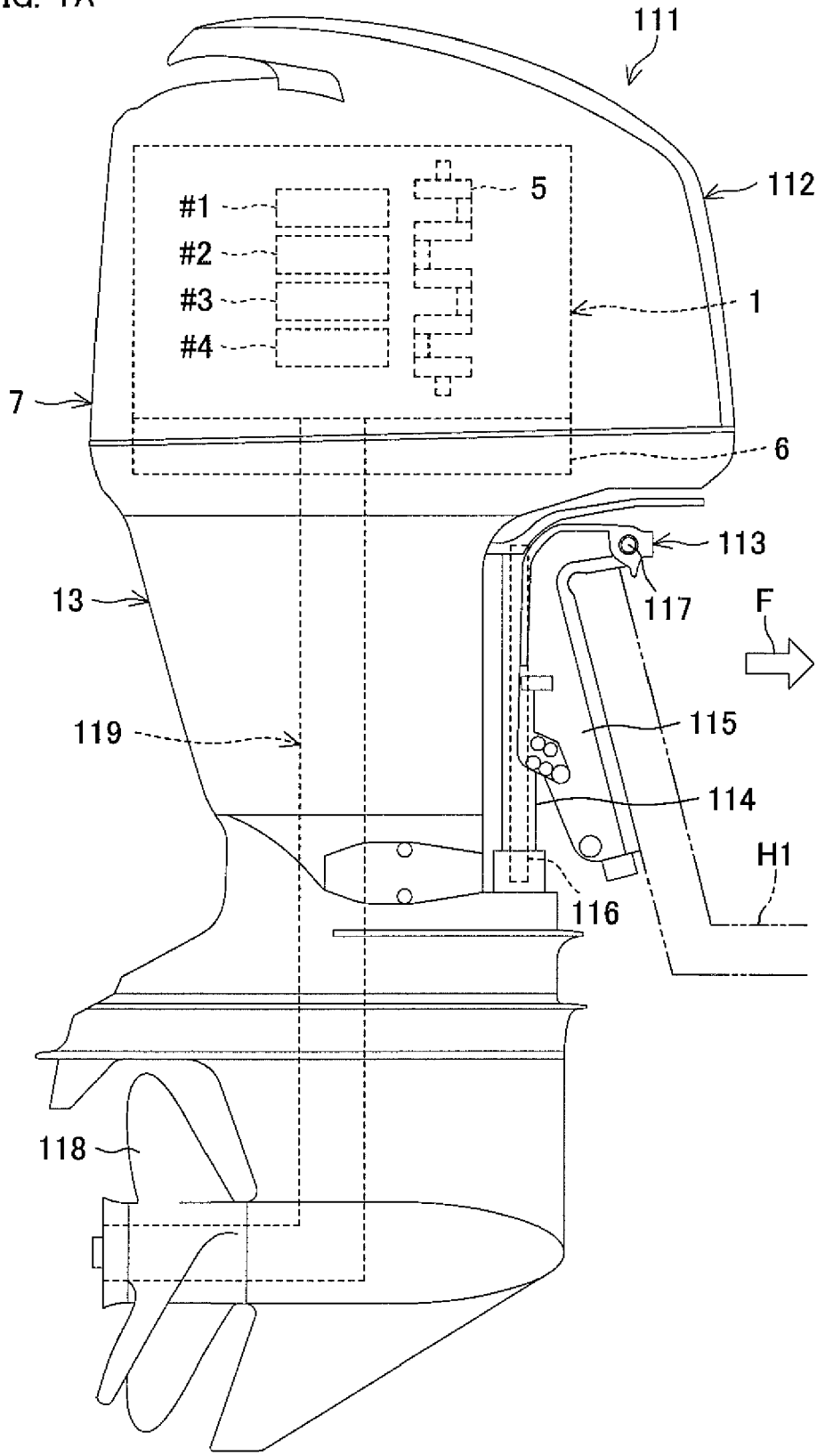
FIG. 1A is a side view of an outboard motor according to a first preferred embodiment of the present invention.

As shown in FIG. 1A, the outboard motor 111 includes an outboard motor main body 112 and an attachment mechanism 113. The outboard motor main body 112 is attached to a rear portion of a hull H1 by the attachment mechanism 113. The attachment mechanism 113 includes a swivel bracket 114, a clamp bracket 115, a swivel shaft 116, and a tilt shaft 117. The swivel shaft 116 is disposed so as to extend vertically. The tilt shaft 117 is disposed horizontally so as to extend to the right and left. The swivel bracket 114 is coupled to the outboard motor main body 112 via the swivel shaft 116. Also, the clamp bracket 115 is coupled to the swivel bracket 114 via the tilt shaft 117. The clamp bracket 115 is fixed to the rear portion of the hull H1.

The outboard motor main body 112 is pivotable to the right and left about the swivel shaft 116 with respect to the swivel bracket 114 and the clamp bracket 115. The hull H1 is steered by the outboard motor main body 112 being pivoted about the swivel shaft 116. Also, the outboard motor main body 112 and the swivel bracket 114 are pivotable vertically about the tilt shaft 117 with respect to the clamp bracket 115. The outboard motor main body 112 is pivoted about the tilt shaft 117 in a state in which a front surface of the outboard motor main body 112 is directed downward. The outboard motor main body 112 is thereby tilted up.

As shown in FIG. 1A, the outboard motor main body 112 includes an engine 1, an exhaust guide 6, an engine cover 7, and an upper casing 13. The engine 1 is an internal combustion engine that generates power by combustion of gasoline or other fuel. The engine 1 is disposed inside the engine cover 7. The engine 1 is disposed such that a crankshaft 5 extends vertically. The engine 1 includes, for example, four cylinders (a first cylinder #1, a second cylinder #2, a third cylinder #3, and a fourth cylinder #4). The first cylinder #1, the second cylinder #2, the third cylinder #3, and the fourth cylinder #4 are aligned vertically in that order from above downwards. The engine 1 is supported from below by the exhaust guide 6. An upper portion of the upper casing 13 is coupled to a lower portion of the exhaust guide 6 (see FIG. 3).

Also, as shown in FIG. 1A, the outboard motor main body 112 includes a propeller 118 and a main exhaust passage 119. The propeller 118 is driven to rotate by the engine 1. A propulsive force that drives the hull H1 forward or in reverse is generated by the rotation of the propeller 118. Also, the main exhaust passage 119 is disposed in an interior of the outboard motor main body 112. A first end portion of the main exhaust passage 119 is connected to the engine 1. A second end portion of the main exhaust passage 119 is connected to the propeller 118. An exit of the main exhaust passage 119 opens underwater. For example, in a state in which the engine 1 is rotating at high speed, exhaust generated at the engine 1 is discharged underwater through the main exhaust passage 119.

Figure 3:
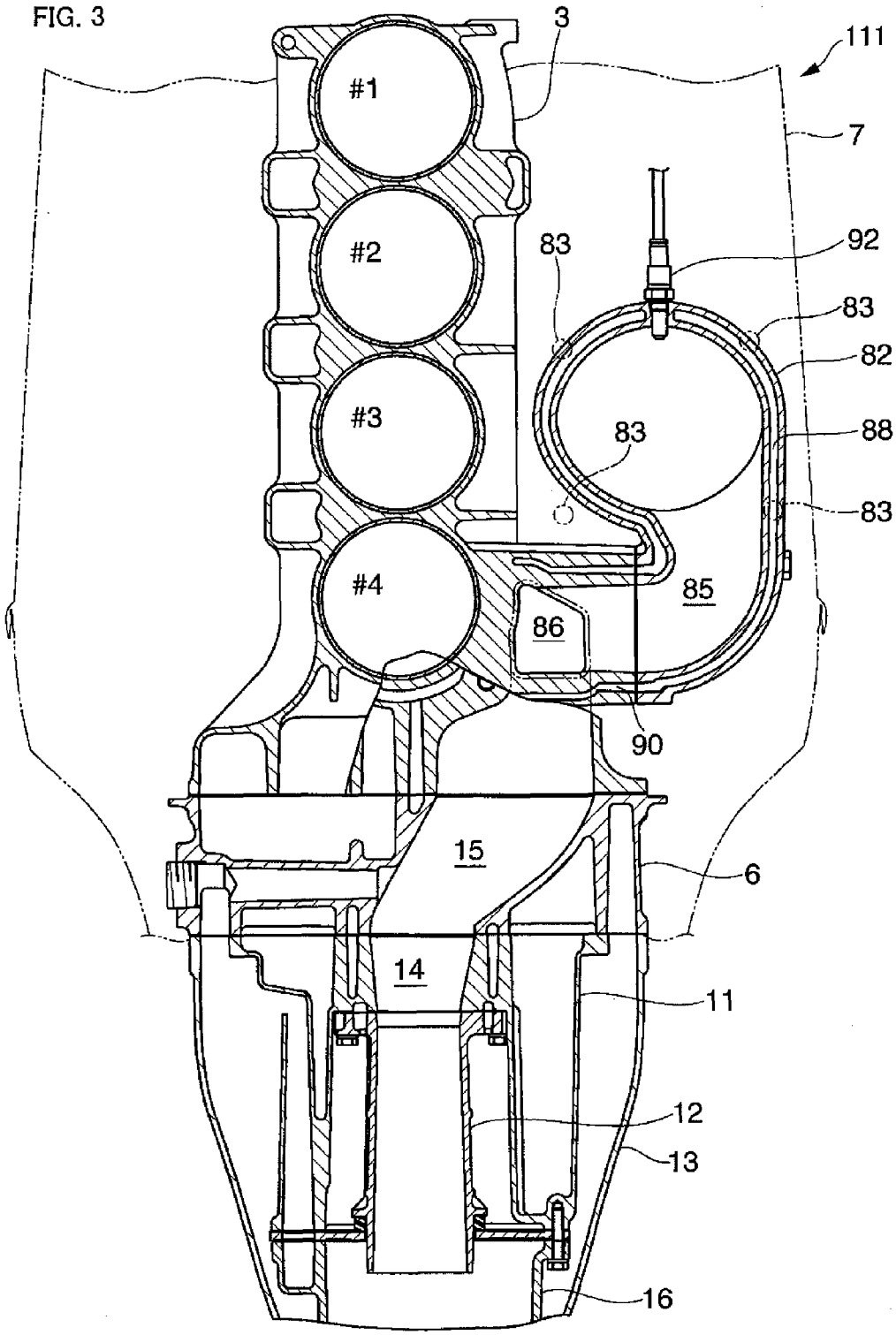
FIG. 3 is a sectional view taken along line III-III in FIG. 2.

Also, as shown in FIG. 3, the outboard motor 111 includes an oil pan 11 disposed below the exhaust guide 6, an exhaust pipe 12, and a muffler 16. The oil pan 11 and the exhaust pipe 12 are housed inside the upper casing 13. An upper portion of the oil pan 11 is attached to a lower portion of the exhaust guide 6. A large portion of the exhaust pipe 12 is disposed inside the oil pan 11. The exhaust pipe 12 is disposed at a central portion of the oil pan 11 in regard to the right/left direction. The exhaust pipe 12 extends vertically inside the oil pan 11.

As shown in FIG. 3, a lower end portion of the exhaust pipe 12 is disposed inside an upper portion of the muffler 16. Also, an upper end portion of the exhaust pipe 12 is attached to the upper portion of the oil pan 11. The exhaust pipe 12 is supported by the exhaust guide 6 via the oil pan 11. The upper end portion of the exhaust pipe 12 is connected to an exhaust passage 14 that penetrates vertically through the upper portion of the oil pan 11. The exhaust passage 14 is connected to an exhaust passage 15 provided in the exhaust guide 6. The exhaust passage 15 extends downward from an upper surface of a right side portion of the exhaust guide 6. Exhaust generated by the engine 1 passes successively through the exhaust passage 15, the exhaust passage 14, an interior of the exhaust pipe 12, and an interior of the muffler 16 and is discharged underwater from the propeller 118. Each of the exhaust passage 15, the exhaust passage 14, the interior of the exhaust pipe 12, and the interior of the muffler 16 is a portion of the main exhaust passage 119.

Figure 1B:
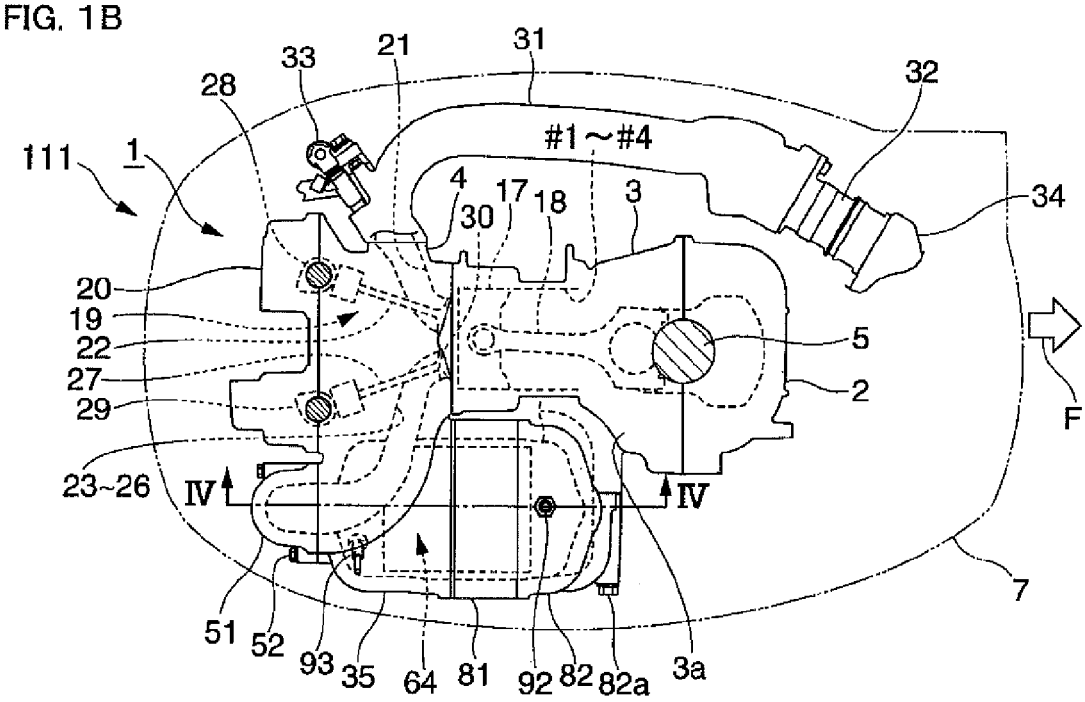
FIG. 1B is a plan view of an engine according to the first preferred embodiment of the present invention.

Also, as shown in FIG. 1B, the engine 1 includes a crankcase 2, a cylinder body 3, a cylinder head 4, and a head cover 20. The crankcase 2, the cylinder body 3, the cylinder head 4, and the head cover 20 are aligned in a front/rear direction in that order from the front. The cylinder body 3 is preferably made, for example, by casting. The cylinder body 3 includes a wide portion 3*a* that is wider in width than other portions of the cylinder body 3. The wide portion 3*a* is disposed at the crankcase 2 side relative to the other portions of the cylinder body 3. Each of the cylinders #1 to #4 is provided in an interior of the cylinder body 3. Each of the cylinders #1 to #4 is arranged to extend in the front/rear direction.

Also, as shown in FIG. 1B, the engine 1 is, for example, a DOHC (double overhead camshaft) type engine. The engine 1 includes a plurality of pistons 17, a plurality of connecting rods 18, and a valve gear 19. The valve gear 19 is covered by the head cover 20. The valve gear 19 includes a plurality of intake valves 22, a plurality of exhaust valves 27, an intake camshaft 28 that drives the respective intake valves 22, and an exhaust camshaft 29 that drives the respective exhaust valves 27. Two each of the intake valves 22 and exhaust valves 27 are provided in each of the cylinders #1 to #4 (see FIG. 8).

Figure 8:
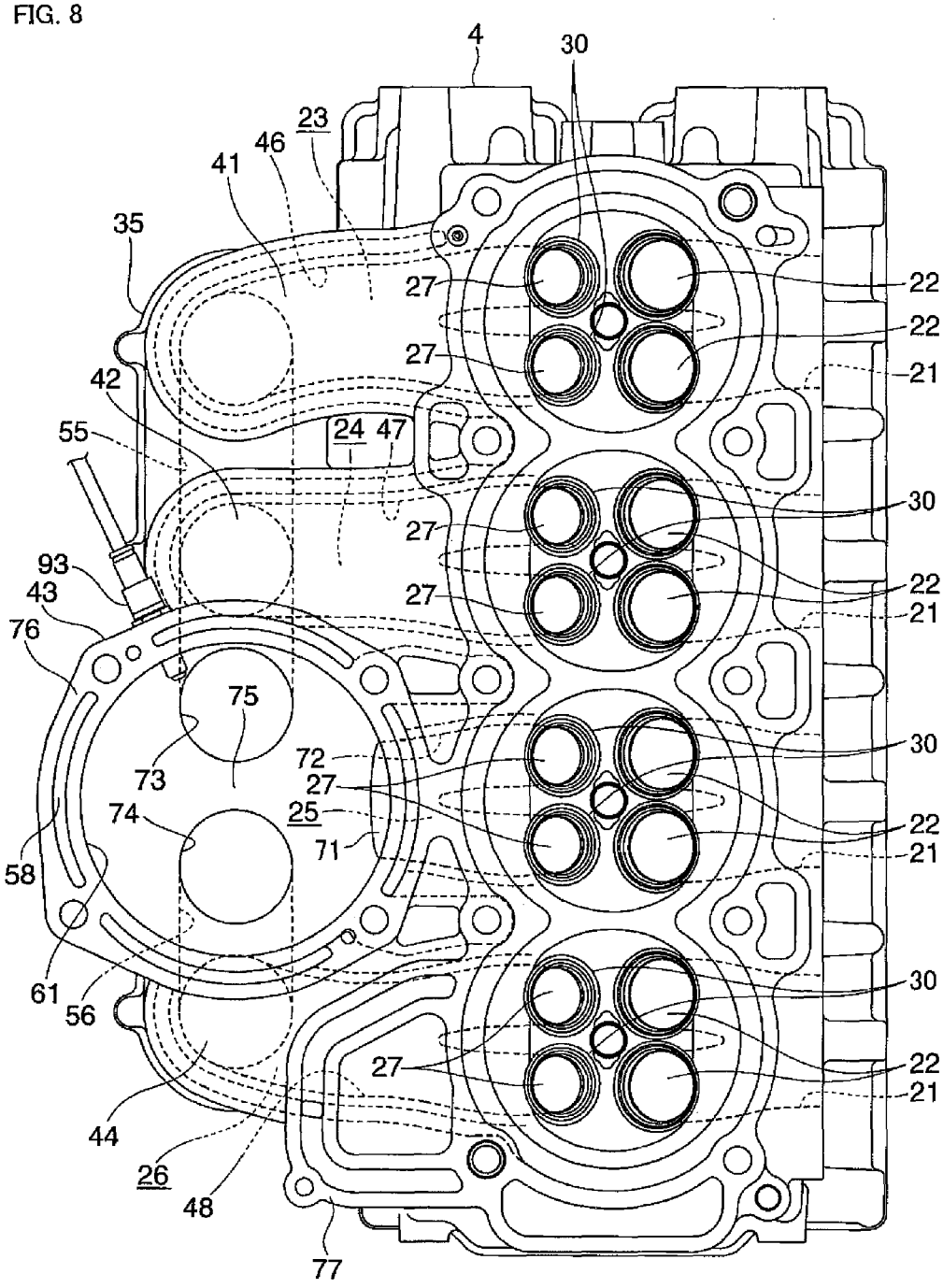
FIG. 8 is a plan view of a cylinder head according to the first preferred embodiment of the present invention.

Also, as shown in FIG. 8, the cylinder head 4 preferably includes four intake ports 21 corresponding to the four cylinders #1 to #4, respectively. Also, the cylinder head 4 preferably includes four pairs of exhaust ports 30 corresponding to the cylinders #1 to #4, respectively. Each of the four intake ports 21 is opened and closed by the corresponding intake valve 22. Also, each of the four pairs of exhaust ports 30 is opened and closed by the corresponding exhaust valve 27. The four pairs of exhaust ports 30 are respectively connected to four passages (a first passage 23, a second passage 24, a third passage 25, and a fourth passage 26). The four passages 23 to 26 correspond to the four cylinders #1 to #4, respectively. As shown in FIG. 1B, each of the passages 23 to 26 extends obliquely rightward toward the rear from the corresponding exhaust port 30. The four passages 23 to 26 are an example of a first exhaust passage and a plurality of passages according to the first preferred embodiment of the present invention.

As shown in FIG. 1B, each intake port 21 opens at a left side surface of the cylinder head 4. Also, the outboard motor 111 includes an intake pipe 31, a throttle valve 32, a fuel injector 33, and a surge tank 34. The intake pipe 31 is connected to the respective intake ports 21. The fuel injector 33 is connected to the intake pipe 31 at a vicinity of the respective intake ports 21. Also, the surge tank 34 is connected via the throttle valve 32 to the intake pipe 31. Intake air taken inside the engine cover 7 is supplied to the intake pipe 31 via the surge tank 34 and the throttle valve 32. The intake air supplied to the intake pipe 31 is supplied to the respective intake ports 21.

Figure 2:
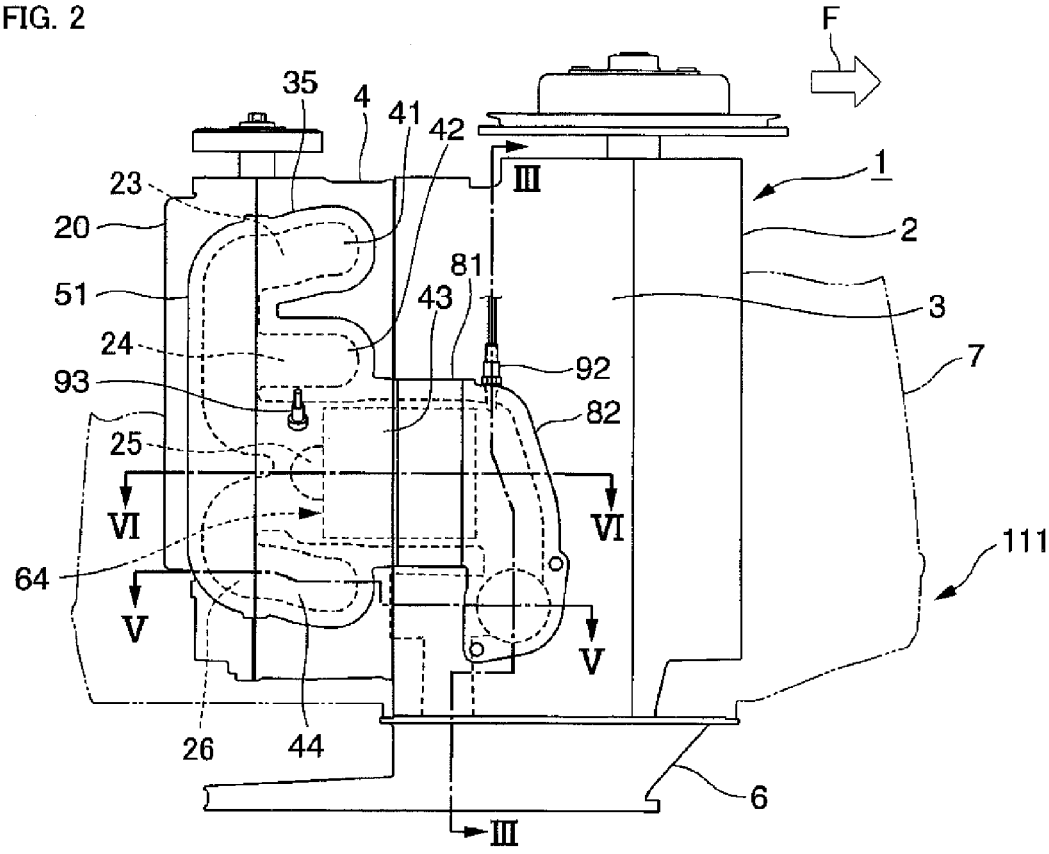
FIG. 2 is a side view of the engine according to the first preferred embodiment of the present invention.

Also, as shown in FIG. 1B, the engine 1 has a protruding portion 35 provided at the cylinder head 4, and a cover 51 coupled to the protruding portion 35. The protruding portion 35 protrudes to the right side. As shown in FIG. 2, the protruding portion 35 includes a first exhaust port portion 41, a second exhaust port portion 42, a catalyst housing portion 43, and a fourth exhaust port portion 44 that are aligned vertically. The first exhaust port portion 41, the second exhaust port portion 42, the catalyst housing portion 43, and the fourth exhaust port portion 44 are aligned vertically in that order from above downwards. The first exhaust port portion 41 and the cover 51 define the first passage 23. The second exhaust port portion 42 and the cover 51 define the second passage 24. The fourth exhaust port portion 44 and the cover 51 define the fourth passage 26. The catalyst housing portion 43 is disposed at substantially the same height as the third passage 25. The cover 51 is an example of a coupling member according to the first preferred embodiment of the present invention.

Figure 4:
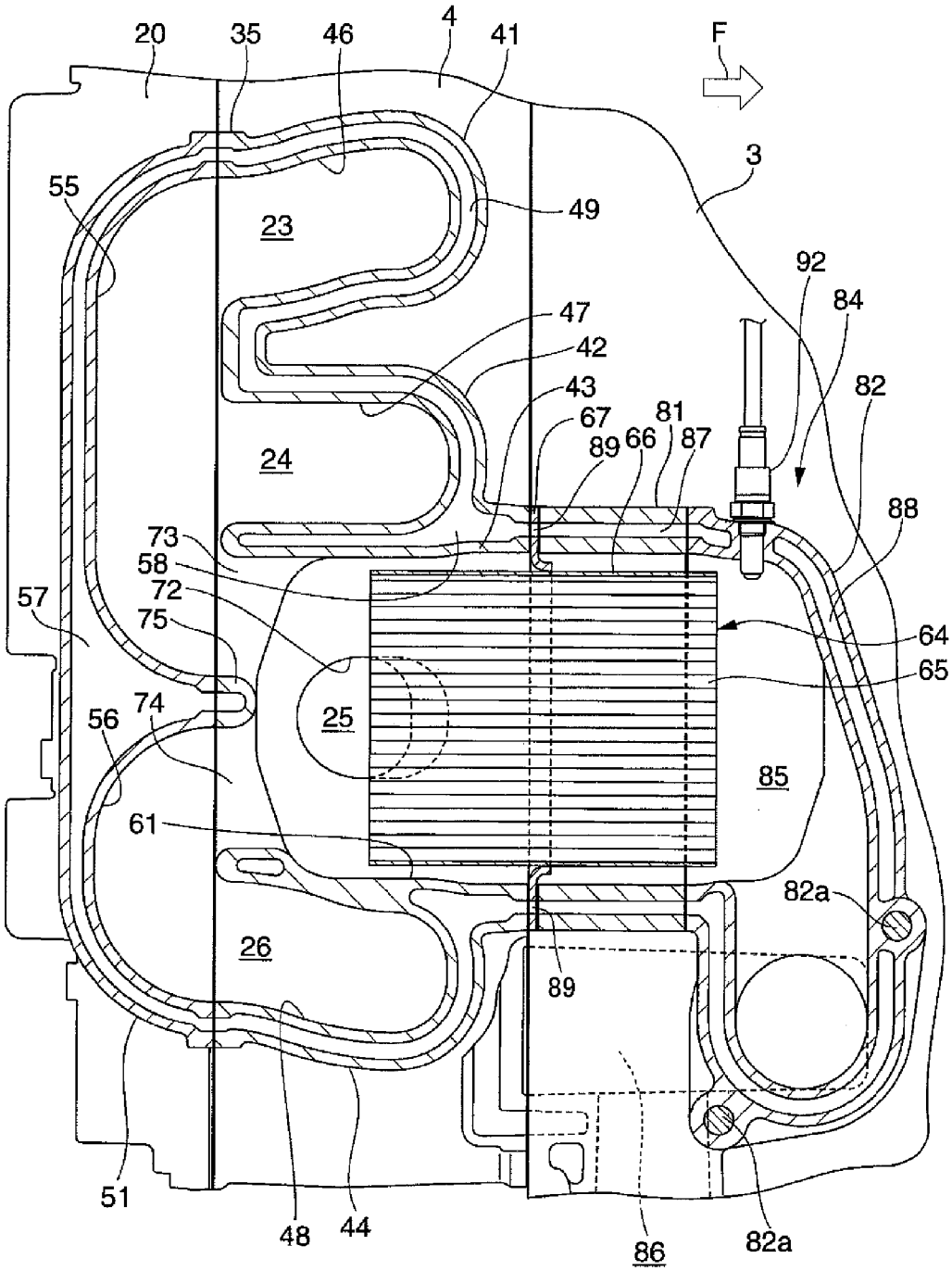
FIG. 4 is a sectional view taken along line IV-IV in FIG. 1B.

Also, as shown in FIG. 4, the first exhaust port portion 41, the second exhaust port portion 42, and the fourth exhaust port portion 44 include a first hole 46, a second hole 47, and a fourth hole 48, respectively. The respective holes 46 to 48 are surrounded by a cooling water passage 49 provided at the three exhaust port portions 41, 42, and 44. As shown in FIG. 8, the respective holes 46 to 48 are connected to the corresponding exhaust ports 30. The respective holes 46 to 48 extend from the corresponding exhaust ports 30 to a rear end surface of the protruding portion 35 (end surface at the opposite side with respect to the cylinder body 3). As shown in FIG. 4, downstream rear ends of the respective holes 46 to 48 open at the rear end surface of the protruding portion 35. Openings of the respective holes 46 to 48 are covered by the cover 51.

Figure 5:
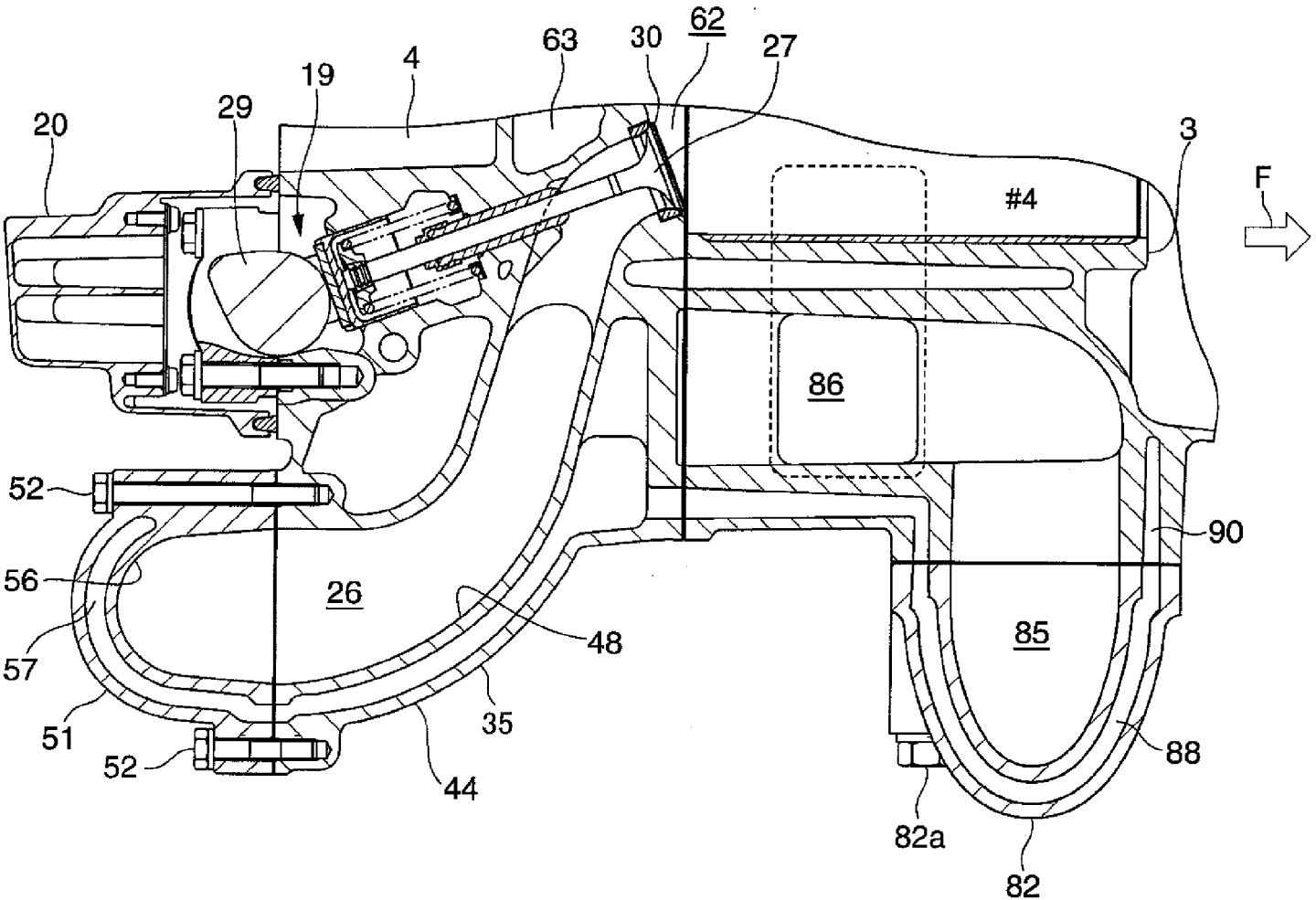
FIG. 5 is a sectional view taken along line V-V in FIG. 2.
Figure 9:
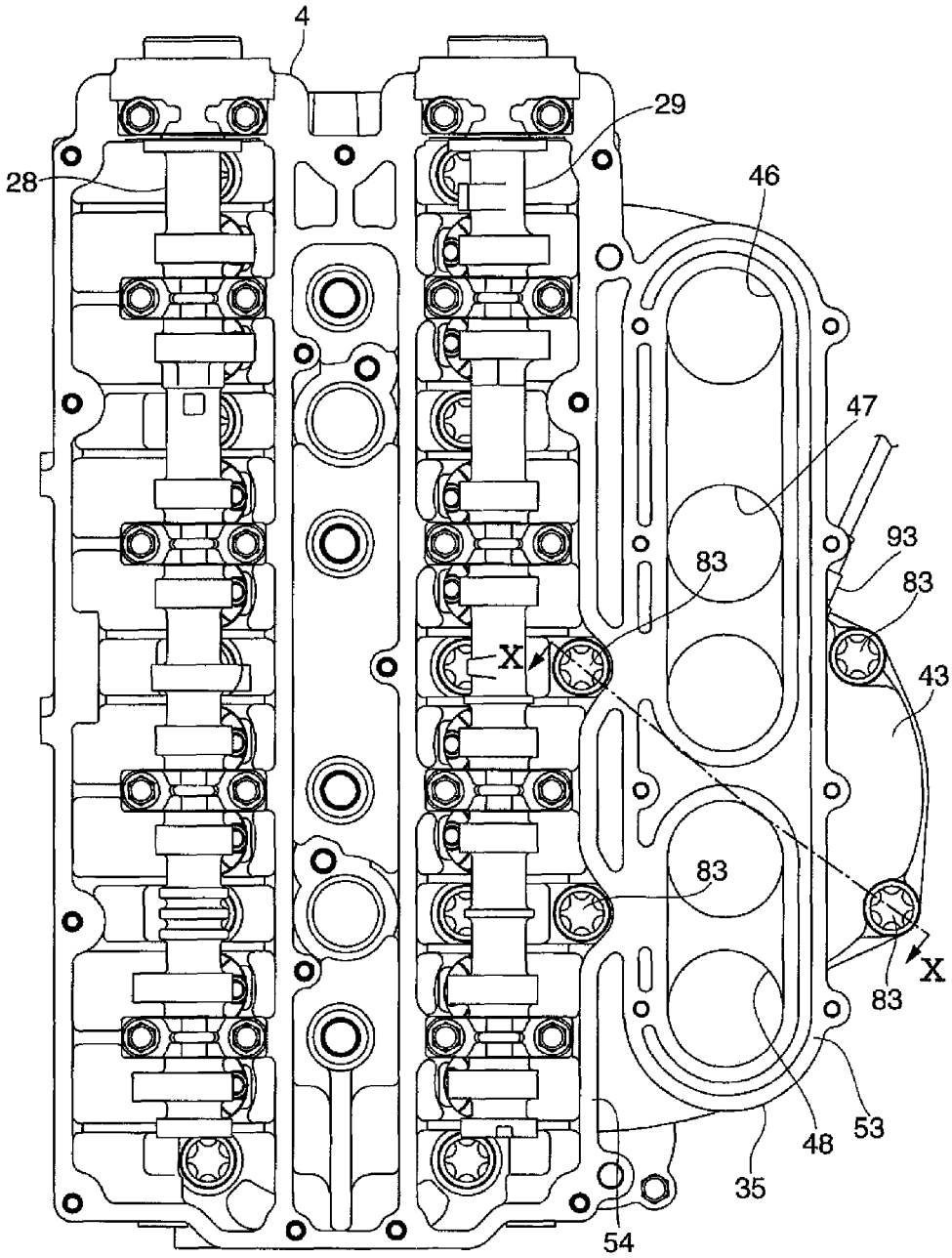
FIG. 9 is a rear view of the cylinder head according to the first preferred embodiment of the present invention.

Also, as shown in FIG. 5, the cover 51 is attached to the rear end surface of the protruding portion 35 by a plurality of fixing bolts 52. As shown in FIG. 9, the rear end surface of the protruding portion 35 includes a mating surface 53 with which the cover 51 is overlapped. Also, the cylinder head 4 includes a mating surface 54 with which the head cover 20 is overlapped. The mating surface 53 and the mating surface 54 are, for example, disposed on the same plane. The mating surface 53 and the mating surface 54 are, for example, made using the same tool (for example, a milling cutter) in the same process.

Also, as shown in FIG. 4, the cover 51 includes an upper groove 55 and a lower groove 56. The upper groove 55 and the lower groove 56 respectively extend vertically. The upper groove 55 is disposed above the lower groove 56. The first passage 23 includes the upper groove 55 and the first hole 46. The second passage 24 includes a portion of the upper groove 55 and the second hole 47. Also, the fourth passage 26 includes the lower groove 56 and the fourth hole 48. The upper groove 55 and the lower groove 56 open at an end surface of the cover 51 at the cylinder head 4 side. Widths (lengths in the right/left direction) of the openings of the upper groove 55 and the lower groove 56 are, for example, substantially equal to widths of the downstream ends of the respective holes 46 to 48 (see FIG. 5).

As shown in FIG. 4, the upper groove 55 extends from a position opposing the downstream end of the first hole 46 to a position opposing the catalyst housing portion 43. The upper groove 55 is connected to the downstream end of the first hole 46, the downstream end of the second hole 47, and the catalyst housing portion 43. The lower groove 56 extends from a position opposing the catalyst housing portion 43 to a position opposing the downstream end of the fourth hole 48. The lower groove 56 is connected to the downstream end of the fourth hole 48 and the catalyst housing portion 43. The first hole 46 and the second hole 47 are connected to the catalyst housing portion 43 via the upper groove 55. The first passage 23 and the second passage 24 share a portion of each other. The fourth hole 48 is connected to the catalyst housing portion 43 via the lower groove 56. The fourth passage 26 is independent of the three passages 23 to 25.

Also, as shown in FIG. 4, the upper groove 55 and the lower groove 56 are surrounded by a cooling water passage 57 provided at the cover 51. The cooling water passage 57 is connected to the cooling water passage 49 provided at the three exhaust port portions 41, 42, and 44, and a cooling water passage 58 provided at the catalyst housing portion 43. The cooling water passage 58 provided at the catalyst housing portion 43 is connected to a cooling water passage 63 provided in a vicinity of a combustion chamber 62 (see FIG. 6). Water outside the outboard motor 111 is taken into the interior of the outboard motor main body 112 by a pump (not shown). A portion of this water (cooling water) is supplied to the cooling water passage 63. The cooling water supplied to the engine 1 is discharged from the engine 1 without circulating inside the engine.

Figure 6:
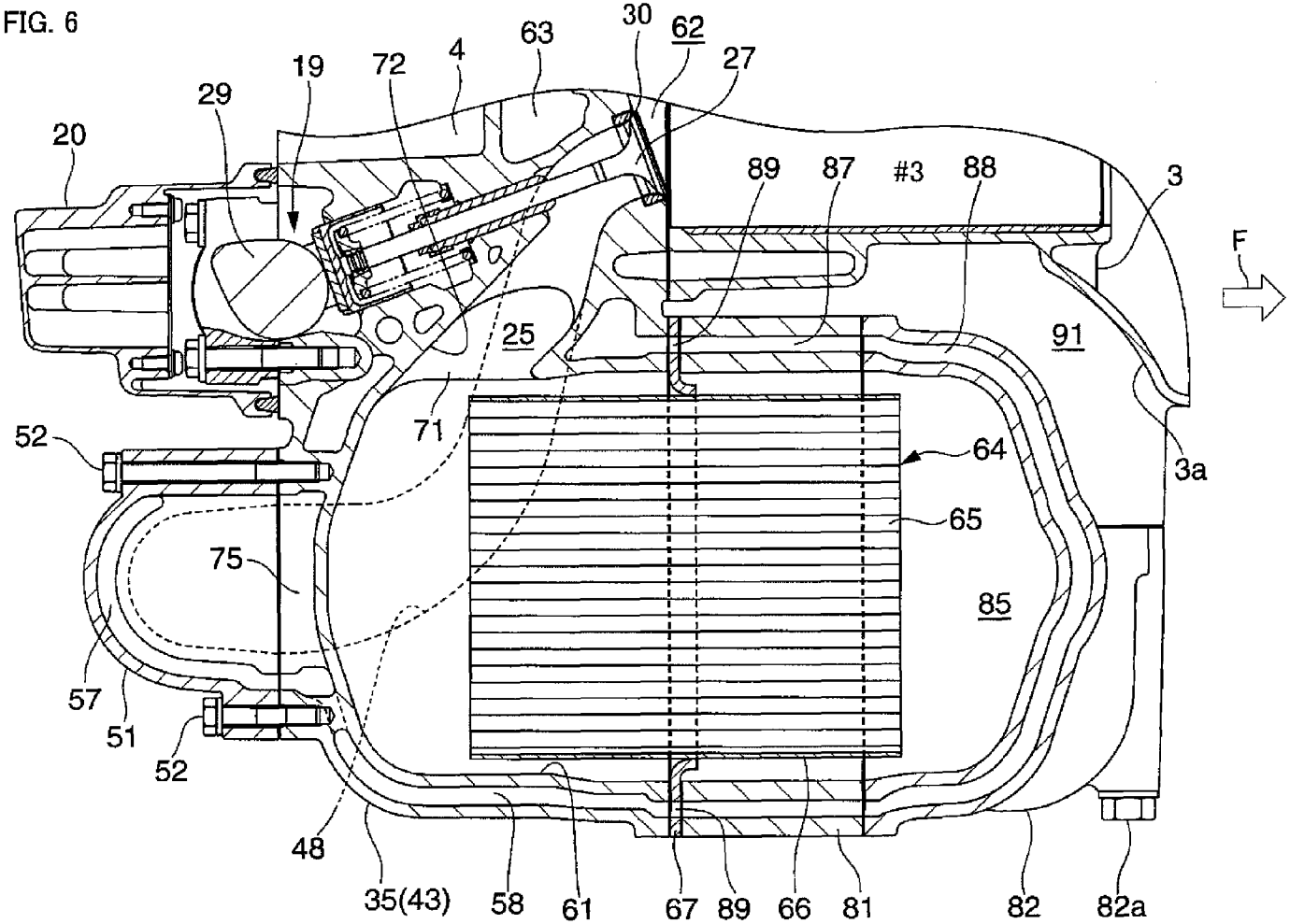
FIG. 6 is a sectional view taken along line VI-VI in FIG. 2.

Also, as shown in FIG. 6, the catalyst housing portion 43 includes a recessed portion 61 which is recessed rearward. The recessed portion 61 extends substantially parallel to the respective cylinders #1 to #4 from a front end surface (end surface proximal to the cylinder body 3) of the protruding portion 35. The recessed portion 61 opens at the front end surface of the protruding portion 35. As shown in FIG. 8, the opening of the recessed portion 61 is, for example, circular. As shown in FIG. 6, a portion of the catalyst 64 is inserted into the recessed portion 61 from the opening of the recessed portion 61. A portion of the catalyst 64 is housed inside the recessed portion 61. The catalyst 64 is, for example, a three-way catalyst. A three-way catalyst is a catalyst that can simultaneously clean hydrocarbons, nitrogen oxides, and carbon monoxide in the exhaust during combustion in a vicinity of a theoretical air-fuel ratio. A cleaning ability of the three-way catalyst is performed adequately when the catalyst itself is at a high temperature.

Figure 7:
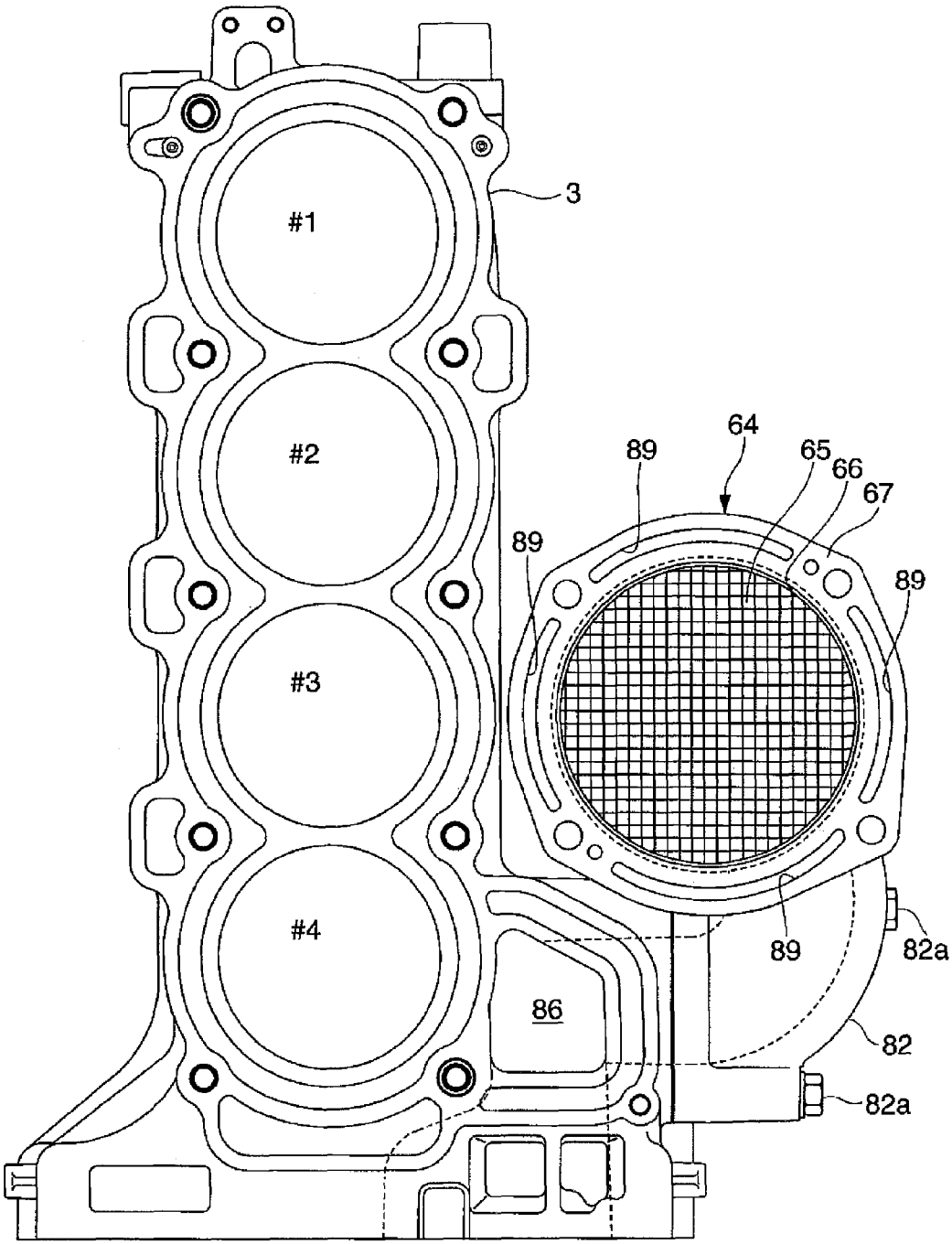
FIG. 7 is a rear view of a cylinder body and a catalyst according to the first preferred embodiment of the present invention.

Also, the catalyst 64 is, for example, a metal catalyst. The metal catalyst is a catalyst that includes a carrier made of a metal. The catalyst 64 is not restricted to being a metal catalyst and may be a catalyst of another type, such as a catalyst that includes a carrier made of ceramic. A metal catalyst is high in strength against thermal shock in comparison to a catalyst that includes a carrier made of ceramic. Also, as shown in FIG. 6 and FIG. 7, the catalyst 64 includes a carrier 65, an outer cylinder 66, and a flange 67. The carrier 65 is made, for example, of a metal, such as stainless steel. The carrier 65 is inserted inside the outer cylinder 66. Also, the outer cylinder 66 is, for example, cylindrical. The outer cylinder 66 is fitted inside the flange 67. The flange 67 is fixed to an outer peripheral portion of the outer cylinder 66, for example, by welding at an intermediate position in the axial direction of the outer cylinder 66.

The carrier 65 has, for example, a spiral shape. In FIG. 6, etc., illustration of the carrier 65 is simplified. Also, the catalyst 64 is disposed such that the exhaust passes through the catalyst 64 in the front/rear direction (axial direction of the catalyst 64). Thus, an outer shape of the catalyst 64 as viewed from a direction of flow of the exhaust is circular. Thus, for example, in comparison to a case where the outer shape of the catalyst 64 is elliptical, a work of forming the carrier 65 to a spiral shape is simple, and manufacture of the carrier 64 is easy.

Also, as shown in FIG. 8, the cylinder head 4 includes a third hole 72 provided inside the cylinder head 4. The third hole 72 is an example of a hole according to the first preferred embodiment of the present invention. The third hole 72 extends from the pair of exhaust ports 30 corresponding to the third cylinder #3 to an inner surface of the recessed portion 61. The third hole 72 includes a lateral exhaust entrance 71 that opens at the inner surface of the recessed portion 61. The third passage 25 is preferably defined by the third hole 72. Exhaust discharged into the third passage 25 passes through the lateral exhaust entrance 71 and flows into the recessed portion 61 from the side. That is, the exhaust discharged from the third cylinder #3 flows into the recessed portion 61 only through the interior of the cylinder head 4.

Also, as shown in FIG. 8, the catalyst housing portion 43 includes an upper exhaust entrance 73 and a lower exhaust entrance 74 that are provided at a bottom of the recessed portion 61 (a portion at a rear side of the recessed portion 61). As shown in FIG. 4, each of the upper exhaust entrance 73 and the lower exhaust entrance 74 penetrates through the bottom of the recessed portion 61. The upper exhaust entrance 73 is disposed above the lower exhaust entrance 74. The upper exhaust entrance 73 and the lower exhaust entrance 74 are partitioned by a bulkhead 75 provided at the bottom of the recessed portion 61. The upper groove 55 is connected to the interior of the recessed portion 61 via the upper exhaust entrance 73. The lower groove 56 is connected to the interior of the recessed portion 61 via the lower exhaust entrance 74.

Exhaust discharged into the first passage 23 and the second passage 24 flows into the recessed portion 61 from the upper exhaust entrance 73. Exhaust discharged into the fourth passage 26 flows into the recessed portion 61 from the lower exhaust entrance 74. The exhaust discharged into the third passage 25 flows into the recessed portion 61 from the lateral exhaust entrance 71. The exhaust flowing into the recessed portion 61 flows inside the recessed portion 61 in the front/rear direction. That is, the exhaust flowing into the recessed portion 61 flows inside the recessed portion 61 in a direction substantially parallel to the catalyst 64. This exhaust flows into the catalyst 64.

The exhaust that is generated in accompaniment with the combustion of a fuel containing hydrogen atoms, such as gasoline, contains water. When such exhaust containing water is cooled, liquid water may form due to condensation. For example, when the exhaust present inside the protruding portion 35 and the cover 51 comes into contact with the inner surface of the protruding portion 35 and the cover 51, dew condensation may occur. Liquid water may thereby gather inside the protruding portion 35 and the cover 51. The liquid water may thus flow into the recessed portion 61 from the upper exhaust entrance 73. However, the liquid water that flows into the recessed portion 61 from the upper exhaust entrance 73 is prevented from entering into the lower exhaust entrance 74 by the bulkhead 75. Entry of liquid water into the lower groove 56 and into the fourth passage 26 is thereby prevented.

Also, as shown in FIG. 8, the catalyst housing portion 43 includes an attachment surface 76 provided at an end portion of the catalyst housing portion 43. The cylinder head 4 includes a mating surface 77 with which the cylinder body 3 is overlapped. The mating surface 77 is an example of a mating surface according to the first preferred embodiment of the present invention. The attachment surface 76 is disposed, for example, on the same plane as the mating surface 77. Also, the attachment surface 76 and the mating surface 77 are, for example, made using the same tool (for example, a milling cutter) in the same process.

Figure 10:
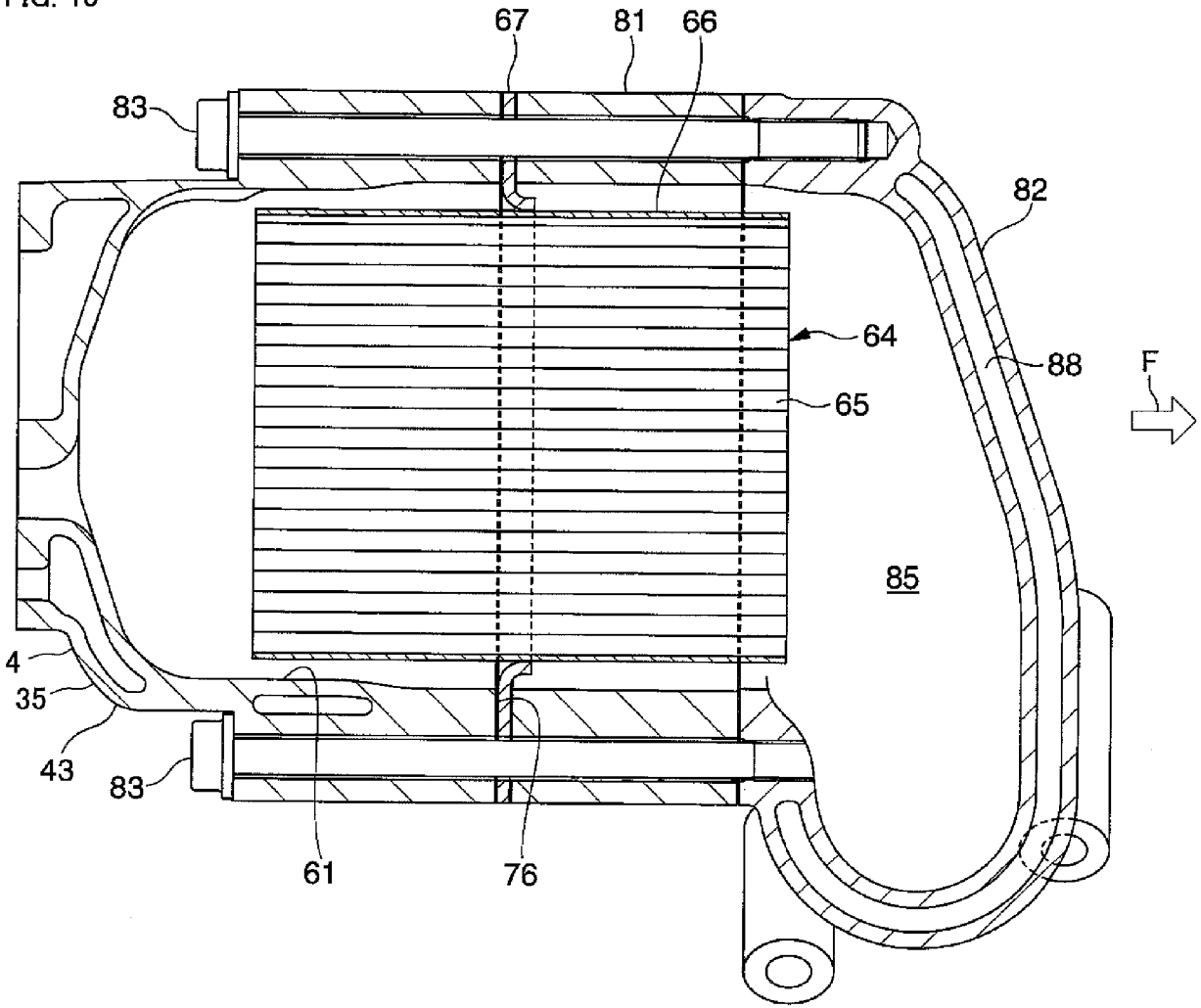
FIG. 10 is a sectional view taken along line X-X in FIG. 9.

As shown in FIG. 10, a portion (upstream side portion) of the catalyst 64 is housed inside the recessed portion 61. The flange 67 is disposed outside the recessed portion 61. The flange 67 is overlapped with the attachment surface 76. The flange 67 is sandwiched by a housing 81 and the recessed portion 61. Also, a joint 82 is coupled to the housing 81 at the opposite side with respect to the flange 67. The catalyst housing portion 43, the flange 67, the housing 81, and the joint 82 are overlapped in that order from the rear to the front.

As shown in FIG. 10, the catalyst 64 is fixed, along with the housing 81 and the joint 82, to the cylinder head 4 (protruding portion 35) by a plurality of bolts 83. Specifically, each bolt 83 is disposed so as to extend in the front/rear direction. Each bolt 83 is attached to the protruding portion 35, the flange 67, the housing 81, and the joint 82, starting from the protruding portion 35 side. Each bolt 83 penetrates through the protruding portion 35, the flange 67, and the housing 81 in the front/rear direction. A tip portion of each bolt 83 is coupled to the joint 82. The protruding portion 35, the flange 67, the housing 81, and the joint 82 are thereby fastened together. By the flange 67 being fixed to the attachment surface 76, the catalyst 64 is fixed to the cylinder head 4.

Also, as shown in FIG. 9, four bolts 83, for example, are preferably provided in the present preferred embodiment. With the four bolts 83, two each are disposed across an interval at right and left sides, respectively. Head portions of the two bolts 83 at an outer side (the right side in FIG. 9) are disposed outside the cylinder head 4. Head portions of the two bolts 83 at an inner side are disposed inside the cylinder head 4. In a state in which the head cover 20 is attached to the cylinder head 4, the head portions of the two bolts 83 at the inner side are covered by the head cover 20. Attachment and removal of the two bolts 83 at the inner side are thus performed in a state in which the head cover 20 is removed from the cylinder head 4.

Also, the housing 81 is, for example, cylindrical. As shown in FIG. 4, the housing 81 is disposed so as to extend in the front/rear direction. The housing 81 has an inner diameter that is larger than an outer diameter of the catalyst 64. A portion of the catalyst 64 (downstream side portion) of the catalyst 64 is housed inside the housing 81. The catalyst 64 and the housing 81 are disposed coaxially. An inner circumferential surface of the housing 81 thus surrounds the catalyst 64 across an interval in a radial direction. The housing 81 and the joint 82 define an exhaust passage 85 of an exhaust device 84. The exhaust passage 85 is an example of a second exhaust passage according to the first preferred embodiment of the present invention. Each of the housing 81 and the joint 82 is an example of a passage defining member according to the first preferred embodiment of the present invention. That is, the housing 81 is an example of a first member according to the first preferred embodiment of the present invention, and the joint 82 is an example of a second member according to the first preferred embodiment of the present invention.

Also, as shown in FIG. 4, the joint 82 is coupled to a front end of the housing 81. The joint 82 extends downward from the front end of the housing 81. A lower end portion of the joint 82 is fixed to the cylinder body 3 preferably by a plurality of fixing bolts 82*a*. As shown in FIG. 3, a lower end portion of the joint 82 is connected to an exhaust passage 86 provided inside the cylinder body 3. The exhaust passage 86 extends downward from a right side of the fourth cylinder #4. The exhaust passage 86 is connected to the exhaust passage 15 provided at the exhaust guide 6.

Also, as shown in FIG. 4, the housing 81 includes a cooling water passage 87 provided in an outer wall of the housing 81. Also, the joint 82 includes a cooling water passage 88 provided in an outer wall of the joint 82. The cooling water passage 87 is connected to the cooling water passage 88. Also, the cooling water passage 87 is connected to the cooling water passage 58 of the catalyst housing portion 43 via a plurality of through holes 89 provided in the flange 67. Also, as shown in FIG. 5, the cooling water passage 88 of the joint 82 is connected to a cooling water passage 90 provided inside the cylinder body 3.

Figure 11:
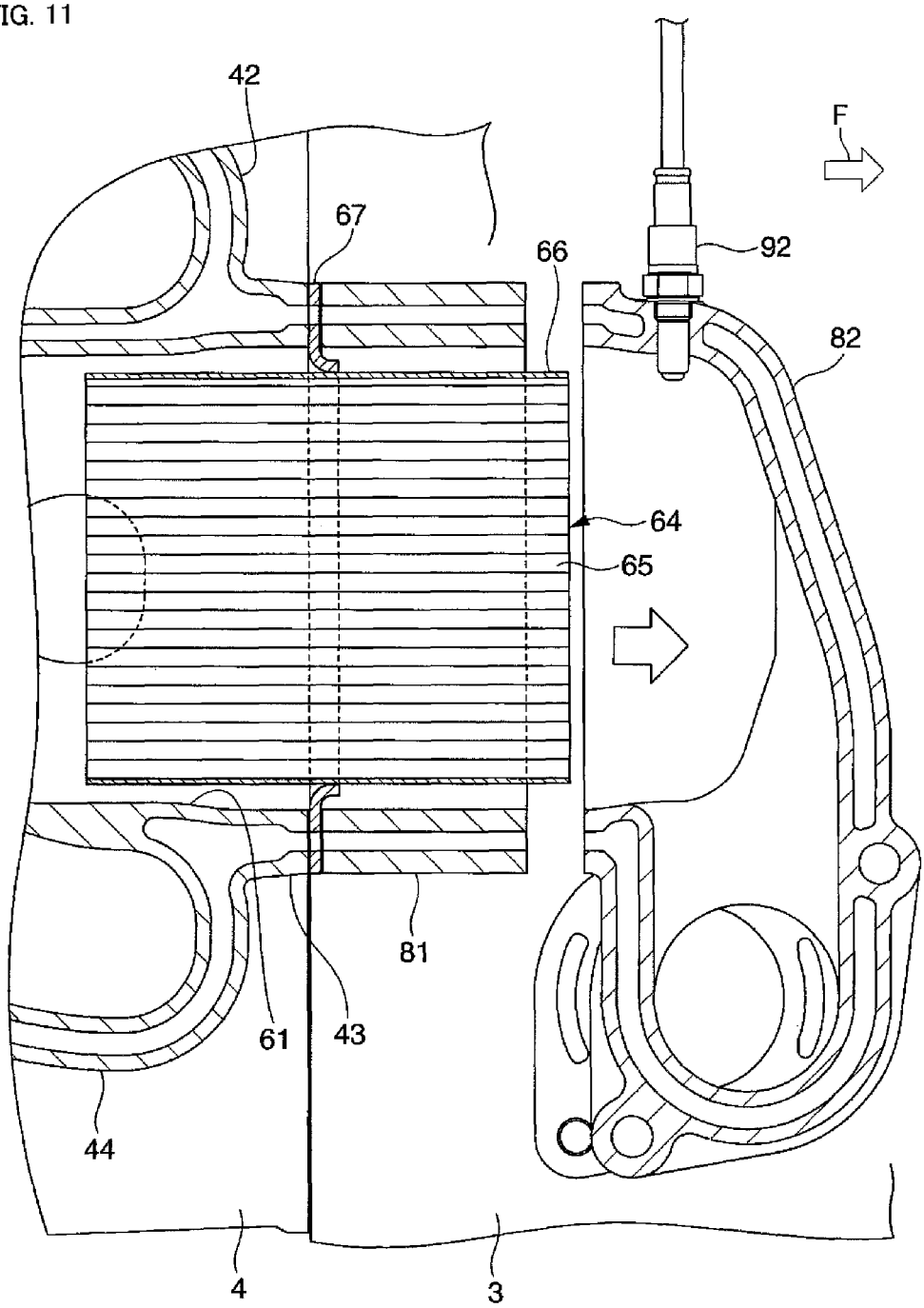
FIG. 11 is a sectional view of a state in which a joint according to the first preferred embodiment of the present invention is removed.

The housing 81 is detachably coupled to the catalyst housing portion 43. Also, the joint 82 is detachably coupled to the housing 81. The joint 82 is removed from the housing 81 by the joint 82 being moved to a space 91 (see FIG. 6) between the joint 82 and the wide portion 3*a*. That is, as shown in FIG. 11, the joint 82 is removed from the housing 81 by moving the joint 82 forward in a state in which all of the bolts 83 are removed. Also, as shown in FIG. 12, the housing 81 is removed from the catalyst housing portion 43 by moving the housing 81 forward in the state in which all of the bolts 83 are removed.

Figure 12:
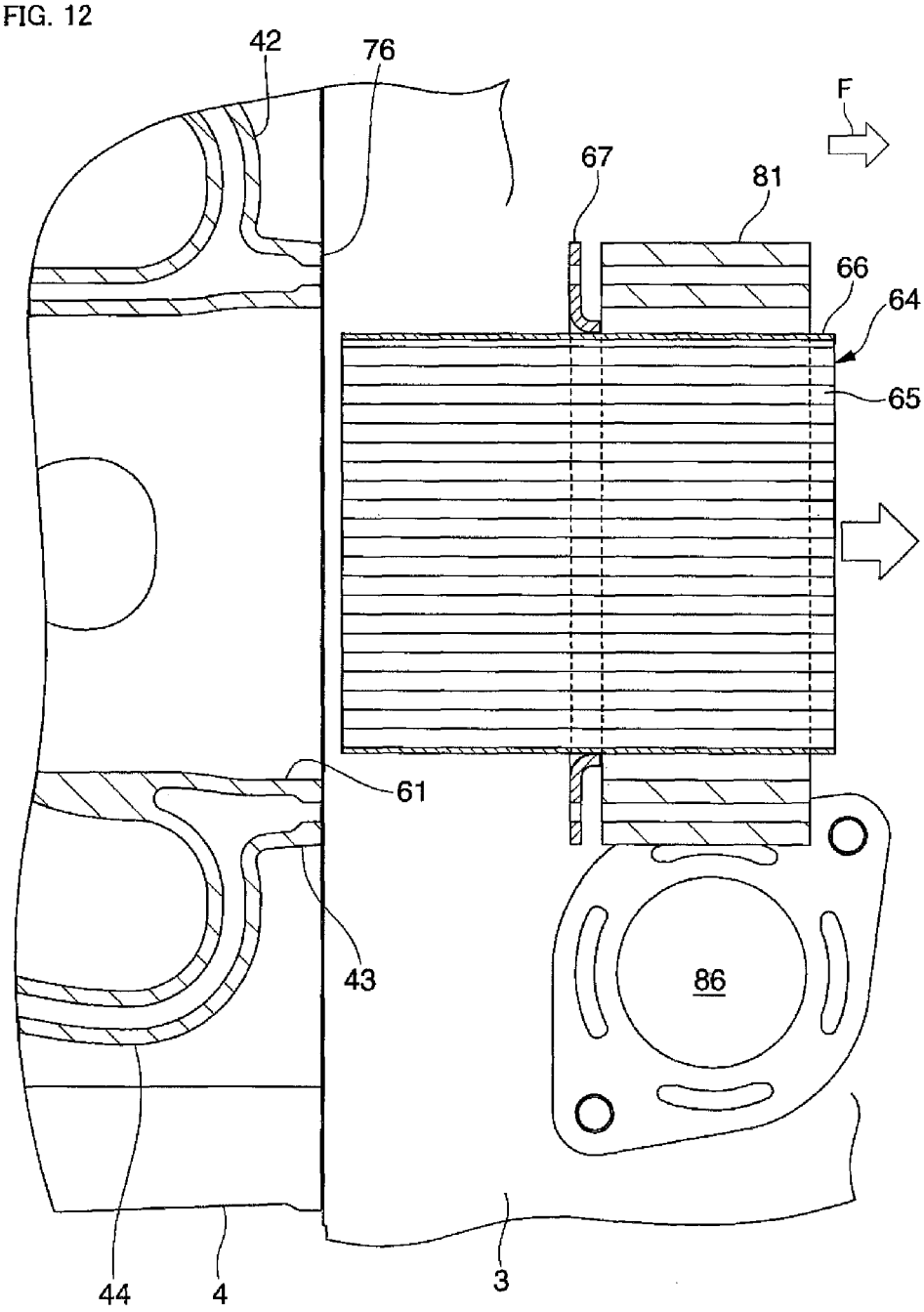
FIG. 12 is a sectional view of a state in which a housing and the catalyst according to the first preferred embodiment of the present invention are removed.

As shown in FIG. 12, the catalyst 64 is removed from the recessed portion 61 by being moved forward in a state in which the housing 81 and the joint 82 are removed. The catalyst 64 is thereby exchanged. The housing 81 and the joint 82 define the exhaust passage 85. That is, for exchange of the catalyst 64 between the protruding portion 35 and the wide portion 3*a*, the members defining the exhaust passage 85 are divided into a plurality of members. A space (a space including the space 91) between the catalyst housing portion 43 and the wide portion 3*a* is set to a size such that the catalyst 64 does not collide with the cylinder body 3 when the catalyst 64 is being removed.

Also, as shown in FIG. 8, an air-fuel ratio sensor 93 is attached to an upper end portion of the catalyst housing portion 43. The air-fuel ratio sensor 93 is an oxygen concentration sensor that includes a ceramic, such as zirconia. An oxygen concentration in the exhaust at the upstream side of the catalyst 64 is detected by the air-fuel ratio sensor 93. Also, as shown in FIG. 4, an abnormality detection sensor 92 is attached to an upper end portion of the joint 82. The abnormality detection sensor 92 preferably is an oxygen concentration sensor that includes a ceramic, such as zirconia, for example. An oxygen concentration in the exhaust at the downstream side of the catalyst 64 is detected by the abnormality detection sensor 92. Abnormality of the air-fuel ratio sensor 93 and degradation of the catalyst 64 are detected by the abnormality detection sensor 92. Specifically, abnormality of the air-fuel ratio sensor 93 is detected, for example, by comparison of a detection value of the air-fuel ratio sensor 93 and a detection value of the abnormality detection sensor 92.

Technical effects and merits of the outboard motor according to the first preferred embodiment of the present invention shall now be described.

With the present preferred embodiment, the four pairs of exhaust ports 30, respectively corresponding to the four cylinders #1 to #4, are provided in the cylinder head 4. Also, the catalyst housing portion 43 that houses the catalyst 64 is provided in the cylinder head 4. The four cylinders #1 to #4 are connected to the catalyst housing portion 43 via the four passages 23 to 26, respectively. The exhaust discharged from the respective cylinders #1 to #4 passes through the catalyst 64 inside the cylinder head 4. A distance (exhaust path length) between the respective exhaust ports 30 and the catalyst 64 can be shortened because the respective exhaust ports 30 and the catalyst housing portion 43 are provided in the same member (cylinder head 4). The catalyst 64 can thereby be maintained at a temperature (high temperature) of high activity.

Specifically, in a state in which the engine 1 is rotating at low speed and an output of the engine 1 is low, a temperature of the engine 1 is lower and a flow rate of exhaust is lower than in a state in which the engine 1 is rotating at high speed or a state in which the output of the engine 1 is high. Also, the exhaust is cooled by the engine 1 before reaching the catalyst 64. Thus, in the state in which the engine 1 is rotating at low speed and the output of the engine 1 is low, a heat amount applied to the catalyst 64 from the exhaust is small. However, a temperature drop of the exhaust that flows into the catalyst 64 is reduced because the distance between the respective exhaust ports 30 and the catalyst 64 can be shortened. The catalyst 64 can thereby be maintained at the temperature of high activity even when the engine 1 is in the above-described state. Also, even in a state in which the temperature of the catalyst 64 is low, the temperature of the catalyst 64 is raised rapidly to a high temperature. The temperature of the catalyst 64 is thereby increased rapidly to a high temperature after starting of the engine 1.

Also, with the present preferred embodiment, a portion (upstream side portion) of the catalyst 64 is disposed inside the cylinder head 4. That is, a portion of the cylinder head 4 functions as a housing that houses the catalyst 64. A number of members arranged to hold the catalyst 64 is thus reduced. Also, a volume occupied by the catalyst 64 and the engine 1 as a whole is reduced because a portion of the catalyst 64 is disposed inside the engine 1. The catalyst 64 can thereby be disposed inside the engine 1 while preventing enlargement of the outboard motor 111.

Also, with the present preferred embodiment, the attachment surface 76 of the catalyst housing portion 43 is disposed on the same plane as the mating surface 77 of the cylinder head 4. The attachment surface 76 and the mating surface 77 can thus be formed easily using the same tool in the same process. Also, the flange 67 of the catalyst 64 is fixed to the attachment surface 76. The catalyst 64 is thereby fixed to the cylinder head 4. The cylinder head 4 has a high rigidity. The catalyst 64 is thus held with stability.

Also, with the present preferred embodiment, the first passage 23, the second passage 24, and the fourth passage 26 are defined by the cylinder head 4 and the cover 51. That is, the first passage 23, the second passage 24, and the fourth passage 26 are defined by a plurality of members. A degree of freedom in design of the shapes of the respective passages 23, 24, and 26 is thus increased. Thus, for example, the first passage 23, the second passage 24, and the fourth passage 26 can be defined to have shapes with which the resistance applied to the exhaust is reduced. The output of the engine 1 can thereby be improved.

Also, the cylinder head 4 can be cast at a high dimensional precision because the first passage 23, the second passage 24, and the fourth passage 26 are defined by the plurality of members. Specifically, each of the first passage 23, the second passage 24, and the fourth passage 26 has a complex shape. Thus, in a case where the first passage 23, the second passage 24, and the fourth passage 26 are defined by a single, cast member, the shape of the cast member is complex. It is thus difficult to cast the cast member with high dimensional precision. However, in the case where the first passage 23, the second passage 24, and the fourth passage 26 are defined by the plurality of members, the shape of each member is simple in comparison to the cast member. The cylinder head 4 can thus be cast with high dimensional precision.

Also, the downstream ends of the first passage 23, the second passage 24, and the fourth passage 26 open at the bottom of the recessed portion 61. The openings of the first passage 23, the second passage 24, and the fourth passage 26 can be used, for example, as holes for gas removal in casting. Also, the openings of the first passage 23, the second passage 24, and the fourth passage 26 can be used for passing through a core print of a core. The core is a mold that is placed inside a main mold to prepare a hollow cast product. Also, the core print is a portion of the core. The core print is attached to the main mold to attach the core to the main mold accurately and reliably.

Also, with the present preferred embodiment, the cylinder head 4 includes the mating surface 53 with which the cover 51 is overlapped, and the mating surface 54 with which the head cover 20 is overlapped. The mating surface 53 and the mating surface 54 are, for example, disposed on the same plane. The mating surface 53 and the mating surface 54 can thus be made easily using the same tool in the same process.

Also, with the present preferred embodiment, the four passages 23 to 26 are respectively disposed at different heights. The fourth passage 26, which is connected to the fourth cylinder #4 that is positioned lowest among the four cylinders #1 to #4, is independent of the three passages 23 to 25 connected to the other three cylinders #1 to #3. That is, the fourth passage 26 is separated from the three passages 23 to 25. Liquid water formed by dew condensation in the three passages 23 to 25 is thus prevented from entering into the fourth passage 26. Thus, for example, even if the exhaust port 30 corresponding to the fourth cylinder #4 is open during stoppage of the engine 1, only the liquid water formed in the fourth passage 26 enters into the fourth cylinder #4. An amount of water that enters into the fourth cylinder #4 is thereby reduced considerably.

Also, with the present preferred embodiment, the third passage 25 is preferably defined by the third hole 72 provided inside the cylinder head 4. The distance (exhaust path length) between the third cylinder #3 and the catalyst 64 can thus be shortened. Also, the exhaust discharged from the third cylinder #3 flows directly into the catalyst 64 without contacting the cover 51. Temperature drop of the exhaust flowing into the catalyst 64 can thereby be reduced. Exhaust of high temperature can thus be guided into the catalyst 64. When the engine 1 is started, the temperature of the engine 1 is low. The temperature of the engine 1 is also low in the state in which the engine 1 is rotated at low speed and the output of the engine 1 is low. However, even in the state in which the temperature of the engine 1 is low, the catalyst 64 can be maintained at the temperature of high activity because the exhaust of high temperature can be guided into the catalyst 64.

Also, with the present preferred embodiment, the air-fuel ratio sensor 93 is attached to the upper end portion of the catalyst housing portion 43. Also, the abnormality detection sensor 92 is attached to the upper end portion of the joint 82. Thus, for example, even if liquid water that has gathered inside the exhaust port 30 during stoppage of the engine 1 is blown to the downstream side by exhaust when the engine 1 is started, the liquid water passes below the sensors 92 and 93. Attachment of liquid water to the two sensors 92 and 93 is thereby prevented. Degradation of the detection precision of the two sensors 92 and 93 is thus prevented.

Second Preferred Embodiment

Figure 13:
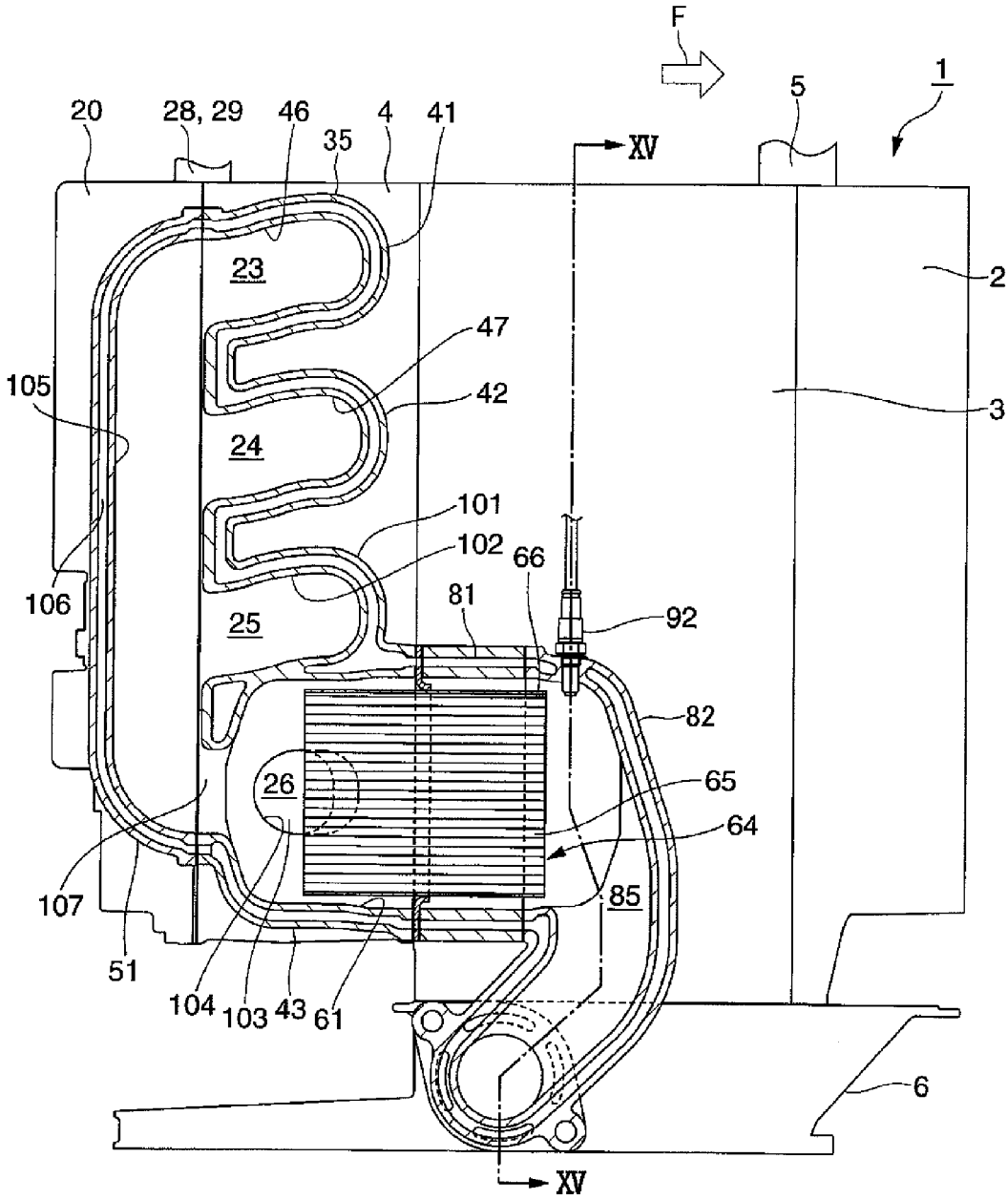
FIG. 13 is a sectional view of an engine according to a second preferred embodiment of the present invention.
Figure 14:
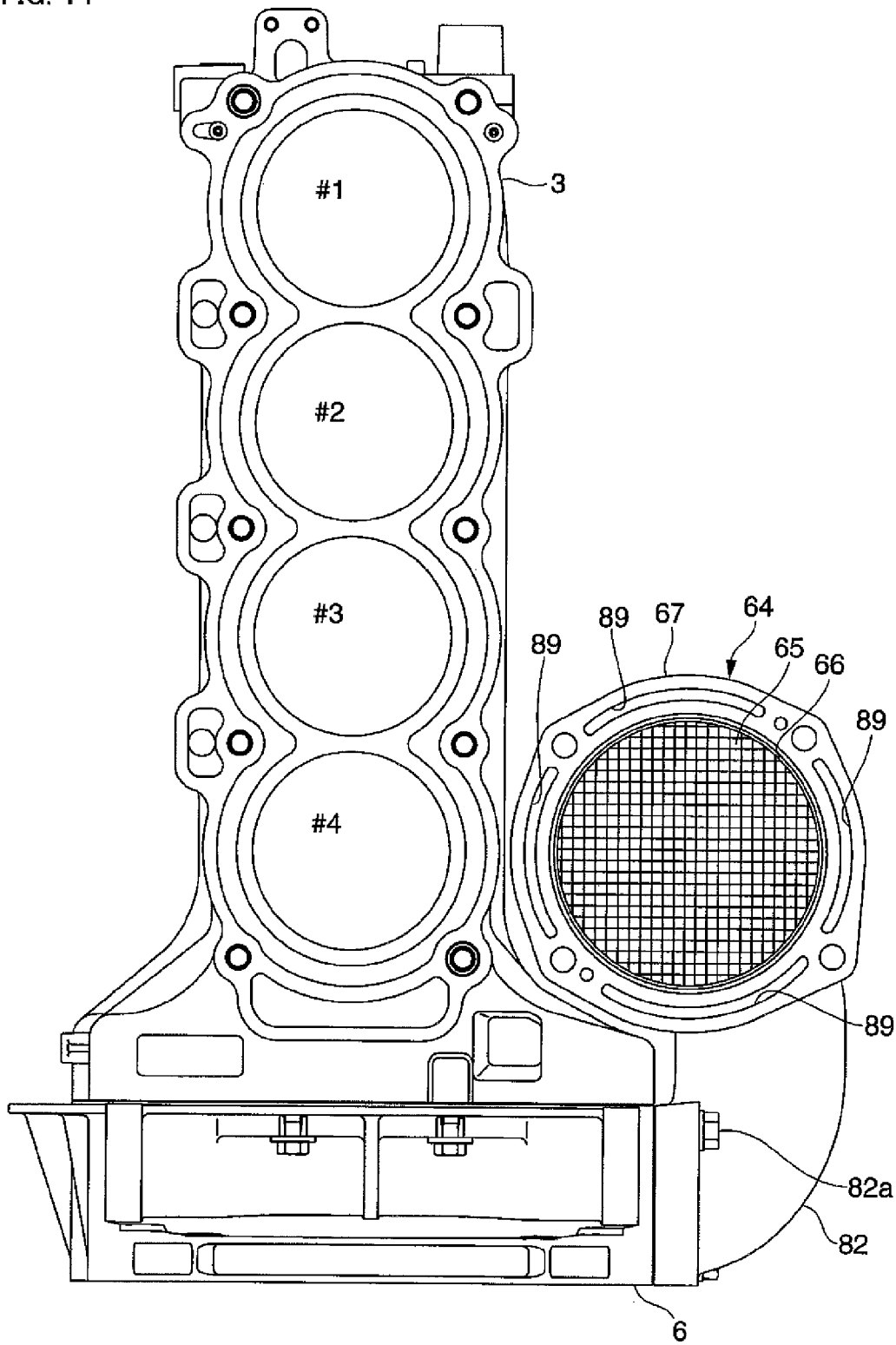
FIG. 14 is a rear view of a cylinder body according to the second preferred embodiment of the present invention.
Figure 15:
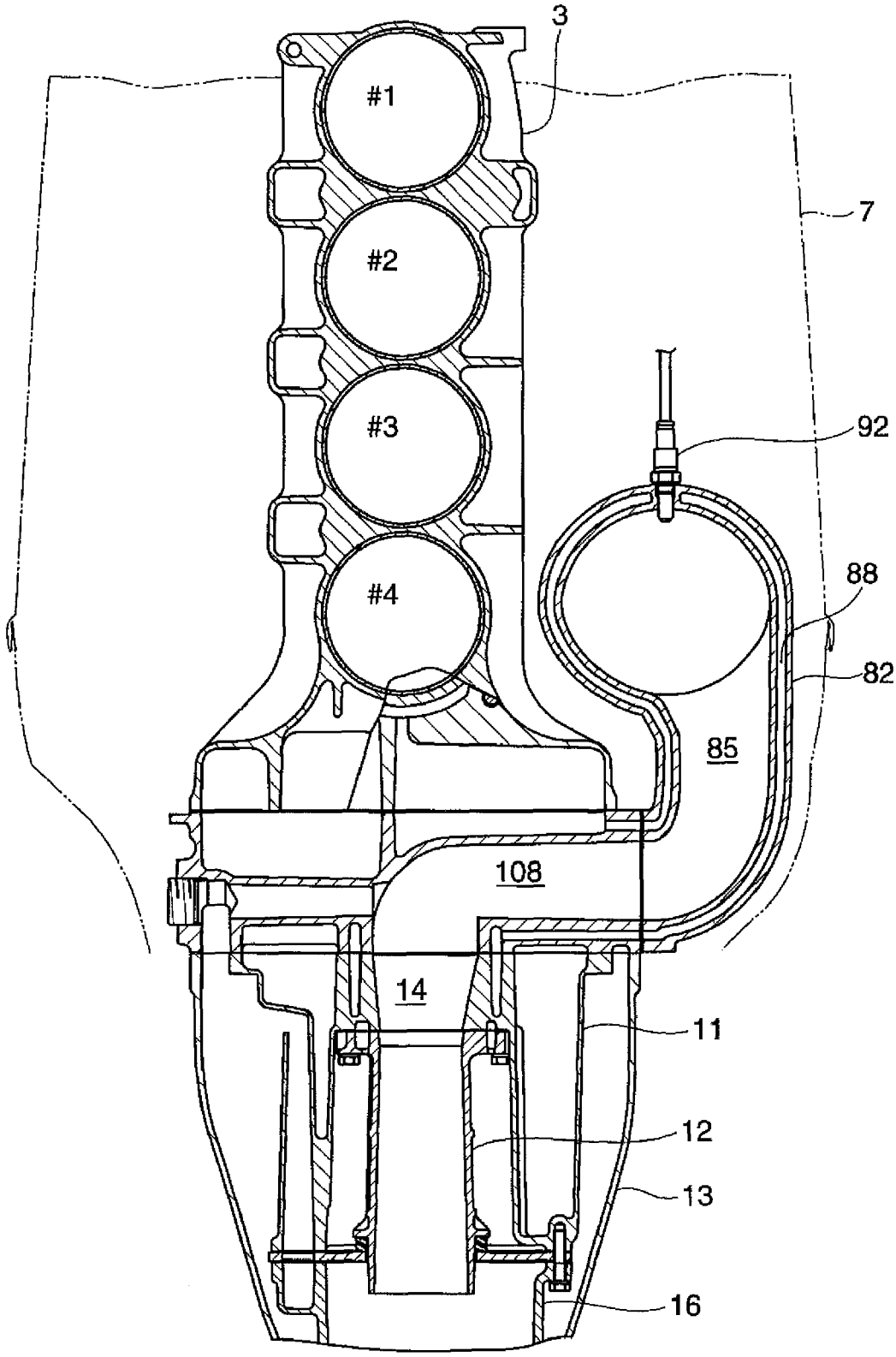
FIG. 15 is a sectional view taken along line XV-XV in FIG. 13.

With the first preferred embodiment, a case where the catalyst 64 is disposed at the side of the third cylinder #3 was described. However, the catalyst 64 may instead be disposed at a side of the fourth cylinder #4 as shown in FIG. 14. In FIG. 13 to FIG. 15, component portions equivalent to respective portions shown in FIG. 1A to FIG. 12 are provided with the same reference symbols as in FIG. 1A, etc., and description thereof shall be omitted where appropriate.

As shown in FIG. 13, the catalyst housing portion 43 is provided at a lower portion of the protruding portion 35. The protruding portion 35 includes a third exhaust port portion 101 disposed above the catalyst housing portion 43. A third hole 102 is provided in the third exhaust port portion 101. The third passage 25 includes the third exhaust port portion 101 and the cover 51. Also, the cylinder head 4 includes a fourth hole 103 provided in the cylinder head 4. The fourth hole 103 is an example of the hole according to a second preferred embodiment of the present invention. The fourth hole extends from the exhaust ports 30 of the fourth cylinder #4 to the recessed portion 61. The fourth hole 103 includes a lateral exhaust entrance 104 that opens at an inner surface of the recessed portion 61. The fourth passage 26 includes the fourth hole 103. The fourth passage 26 is connected to the fourth cylinder #4 that is positioned lowest among the four cylinders #1 to #4. The fourth passage 26 is independent of the three passages 23 to 25 connected to the other three cylinders #1 to #3.

Also, as shown in FIG. 13, the cover 51 has a groove 105. The groove 105 extends vertically. The groove 105 is surrounded by a cooling water passage 106 provided in the cover 51. The groove 105 extends downward from a position opposing the downstream end of the first hole 46 to a position opposing a rear exhaust entrance 107 of the catalyst housing portion 43. The groove 105 is connected to the first hole 46, the second hole 47, the third hole 102, and the rear exhaust entrance 107. The exhaust discharged from the first cylinder #1, the second cylinder #2, and the third cylinder #3 is discharged into the catalyst housing portion 43 through the rear exhaust entrance 107. Also, the exhaust discharged from the fourth cylinder #4 is discharged into the catalyst housing portion 43 through the lateral exhaust entrance 104.

Also, as shown in FIG. 14 and FIG. 15, the lower end portion of the joint 82 is attached to a right side portion of the exhaust guide 6. As shown in FIG. 15, the lower end portion of the joint 82 is connected to an exhaust passage 108 provided inside the exhaust guide 6. The exhaust passage 108 extends substantially horizontally from a right end surface of the exhaust guide 6 to a central portion of the exhaust guide 6 in regard to the right/left direction. The exhaust passage 108 then extends downward from the central portion of the exhaust guide 6 in regard to the right/left direction. A downstream end of the exhaust passage 108 opens at a lower surface of the exhaust guide 6. The exhaust passage 108 is connected to the exhaust passage 14 that penetrates vertically through the upper portion of the oil pan 11.

Third Preferred Embodiment

Figure 16:
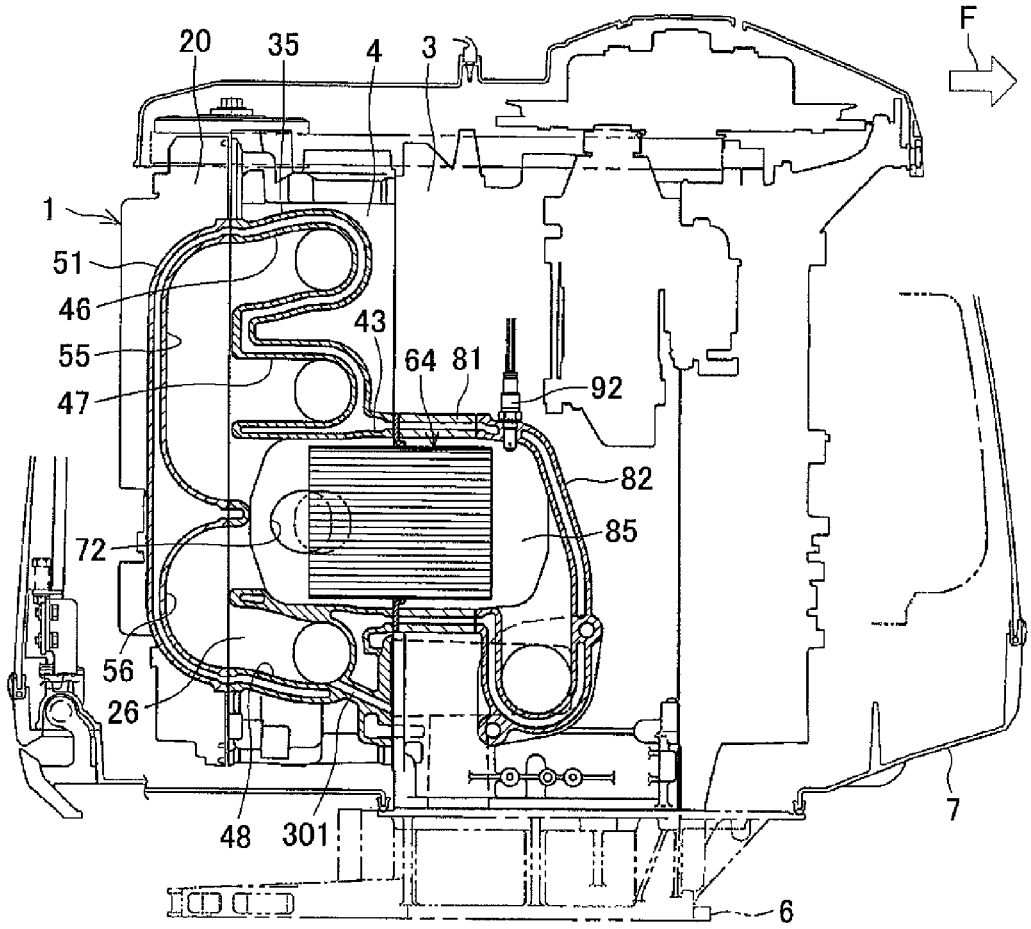
FIG. 16 is a sectional view of an engine according to a third preferred embodiment of the present invention.

FIG. 16 is a side view of an engine according to a third preferred embodiment of the present invention. An outboard motor according to the third preferred embodiment of the present invention shall now be described with reference to FIG. 16. The outboard motor according to the third preferred embodiment of the present invention includes a drain passage arranged to drain liquid water formed inside the engine. In FIG. 16, component portions equivalent to respective portions shown in FIG. 1A to FIG. 12 are provided with the same reference symbols as in FIG. 1A, etc., and description thereof shall be omitted where appropriate.

The protruding portion 35 of the cylinder head 4 includes a drain passage 301. The drain passage 301 is provided at a lower portion of the protruding portion 35. The drain passage 301 is connected to a lowermost portion of the fourth hole 48. The drain passage 301 extends downward from the lowermost portion of the fourth hole 48. The drain passage 301 may be defined by the cylinder head 4 as shown in FIG. 16, or may be defined by another member (for example, a pipe made of a metal) connected to the cylinder head 4. Or, the drain passage 301 is not restricted to being connected to the fourth hole 48 and may instead be connected to the lower groove 56.

Also, the upper end of the catalyst housing portion 43 is positioned above the pair of exhaust ports 30 corresponding to the fourth cylinder #4 (see FIG. 8). The upper end of the catalyst 64 is thus positioned above the pair of exhaust ports 30 corresponding to the fourth cylinder #4. Thus, as shown in FIG. 16, at least a portion of the fourth passage 26 rises towards the catalyst 64. Thus, when liquid water is gathered in the fourth passage 26, this liquid water flows in reverse in the fourth passage 26 and approaches the fourth cylinder #4. However, the liquid water enters into the drain passage 301 and is discharged from the fourth passage 26. Entry of liquid water into the fourth cylinder #4 is thereby prevented.

The present application corresponds to Japanese Patent Application No. 2009-067651 filed in the Japan Patent Office on Mar. 19, 2009, the entire disclosure of which is application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine including a cylinder body and a cylinder head that are aligned in a front/rear direction;

a catalyst housed inside the engine; and a catalyst housing portion provided at a side portion of the cylinder head; wherein the engine includes an exhaust port provided in the cylinder head, a first exhaust passage to guide exhaust discharged from the exhaust port into an interior of the catalyst housing portion, and a second exhaust passage that receives the exhaust that has passed through the interior of the catalyst housing portion;

the catalyst is housed inside the engine such that at least a portion of the catalyst is housed in the interior of the catalyst housing portion;

the first exhaust passage is surrounded by a cooling water passage to which water outside the outboard motor is supplied; and a drain passage is connected to the first exhaust passage at a location that is upstream of the catalyst and downstream of the exhaust port.

2. The outboard motor according to claim 1, wherein the cylinder head includes a mating surface in contact with the cylinder body;

the catalyst housing portion includes an attachment surface disposed on a same plane as the mating surface; and the catalyst is attached to the attachment surface.

3. The outboard motor according to claim 1, wherein the engine includes a plurality of cylinders that are aligned vertically;

the first exhaust passage includes a plurality of passages, each of the plurality of passages is connected to a respective one of the plurality of cylinders; and at least one passage among the plurality of passages includes a hole provided in the cylinder head.

4. The outboard motor according to claim 1, wherein the second exhaust passage includes a first member to house a portion of the catalyst, and a second member coupled to the first member.

5. The outboard motor according to claim 1, wherein the drain passage is connected to a lowermost portion of the first exhaust passage.

6. The outboard motor according to claim 1, wherein the catalyst housing portion is disposed such that exhaust flows inside the catalyst housing portion in the front/rear direction.

7. An outboard motor comprising:

an engine including a cylinder body and a cylinder head that are aligned in a front/rear direction;

a catalyst housed inside the engine; and a catalyst housing portion provided at a side portion of the cylinder head; wherein the engine includes an exhaust port provided in the cylinder head, a first exhaust passage to guide exhaust discharged from the exhaust port into an interior of the catalyst housing portion, and a second exhaust passage that receives the exhaust that has passed through the interior of the catalyst housing portion;

the catalyst is housed inside the engine such that at least a portion of the catalyst is housed in the interior of the catalyst housing portion; and the engine includes a coupling member coupled to the cylinder head, and the first exhaust passage includes the cylinder head and the coupling member.

8. The outboard motor according to claim 7, wherein the engine includes a plurality of cylinders that are aligned vertically;

the first exhaust passage includes a plurality of passages, each of the plurality of passages is connected to a respective one of the plurality of cylinders; and a portion of the passage connected to the cylinder that is positioned lowest is defined by a groove in the coupling member so as to be separated from the passages connected to other cylinders of the plurality of cylinders.

* * * * *